US010735860B2

(12) United States Patent
Chang et al.

(10) Patent No.: US 10,735,860 B2
(45) Date of Patent: Aug. 4, 2020

(54) SOUNDBAR

(71) Applicant: Creative Technology Ltd, Singapore (SG)

(72) Inventors: Thean Kuie Christopher Chang, Singapore (SG); Kok Huan Ong, Singapore (SG)

(73) Assignee: Creative Technology Ltd, Singapore (SG)

( * ) Notice: Subject to any disclaimer, the term of this patent is extended or adjusted under 35 U.S.C. 154(b) by 0 days.

(21) Appl. No.: 16/060,014

(22) PCT Filed: Nov. 9, 2016

(86) PCT No.: PCT/SG2016/050556

§ 371 (c)(1),
(2) Date: Jun. 6, 2018

(87) PCT Pub. No.: WO2017/099666

PCT Pub. Date: Jun. 15, 2017

(65) Prior Publication Data

US 2018/0359566 A1 Dec. 13, 2018

(30) Foreign Application Priority Data

Dec. 7, 2015 (SG) ..... 10201510013T

(51) Int. Cl.

| | |
|---|---|
| ***H04R 3/14*** | (2006.01) |
| ***H04R 1/40*** | (2006.01) |
| ***H04R 3/12*** | (2006.01) |
| ***H04R 1/26*** | (2006.01) |
| ***H04R 1/02*** | (2006.01) |

(Continued)

(52) U.S. Cl.

CPC ..... *H04R 3/14* (2013.01); *H04R 1/025* (2013.01); *H04R 1/26* (2013.01); *H04R 1/403* (2013.01); *H04R 3/12* (2013.01); *H04R 1/24* (2013.01); *H04R 5/02* (2013.01); *H04R 5/04* (2013.01); *H04R 2201/403* (2013.01); *H04R 2201/405* (2013.01); *H04S 7/30* (2013.01)

(58) Field of Classification Search

CPC . H04R 3/12; H04R 3/14; H04R 1/025; H04R 1/26; H04R 1/403; H04R 1/24; H04R 5/02; H04R 5/04; H04R 2201/403; H04R 2201/405; H04S 7/30

USPC ..... 381/80, 89, 124, 335, 356

See application file for complete search history.

(56) References Cited

U.S. PATENT DOCUMENTS 8,542,854 B2 9/2013 Riggs et al.
9,456,278 B2 * 9/2016 Tanaka ..... H04R 3/12

(Continued)

FOREIGN PATENT DOCUMENTS

KR 1020140025268 A 3/2014
WO 2013006323 A2 1/2013

*Primary Examiner* — William A Jerez Lora

(74) *Attorney, Agent, or Firm* — Russell Swerdon; Desmund Gean

(57) ABSTRACT

There is provided an apparatus which can include a plurality of speaker drivers and a control processor. The control processor can be configured to flexibly group the speaker drivers. The control processor can be further configured to perform the tasks of controlling directivity of audio output from at least one group and providing time delay to audio output from at least one speaker driver from at least one controlled group so as to generate at least one sound field associable with a dispersed profile.

11 Claims, 7 Drawing Sheets

(51) Int. Cl.

| | |
|---|---|
| *H04R 5/02* | (2006.01) |
| *H04R 5/04* | (2006.01) |
| *H04S 7/00* | (2006.01) |
| *H04R 1/24* | (2006.01) |

(56) References Cited

U.S. PATENT DOCUMENTS

| | | | | |
|---|---|---|---|---|
| 2008/0212805 | A1* | 9/2008 | Fincham | H04R 3/12 381/160 |
| 2009/0087000 | A1* | 4/2009 | Ko | H04R 1/403 381/182 |
| 2012/0014525 | A1 | 1/2012 | Ko et al. | |
| 2012/0063618 | A1 | 3/2012 | Tanaka et al. | |
| 2014/0211945 | A1* | 7/2014 | Norimatsu | H04S 1/002 381/17 |
| 2015/0016643 | A1 | 1/2015 | Steffens | |
| 2018/0035202 | A1* | 2/2018 | Borss | H04R 3/12 |

* cited by examiner

SOUNDBAR

FIELD OF INVENTION

The present disclosure generally relates a soundbar which is generally capable of both audio and video related operations.

BACKGROUND

Current soundbars are dedicated to audio related functions. Specifically, current soundbars are mostly dedicated to enhancing audio perception of audio signals from media player devices (e.g., MP3 players) to which they are paired with so as to improve user enjoyment/experience.

If a user desires video playback, another device capable of video playback will be required. As such, consumers end up needing a plurality of devices for complete entertainment.

Appreciably, the need for a plurality of devices may lead to clutter.

It is therefore desirable to provide a solution to address the foregoing problem.

SUMMARY OF THE INVENTION

In accordance with an aspect of the disclosure, there is provided an apparatus (i.e., a soundbar) having a plurality of speaker drivers.

The apparatus can include a control processor.

The control processor can be configured to:

1) flexibly group the speaker drivers; and
2) perform the tasks of controlling directivity of audio output from at least one group and providing time delay to audio output from at least one speaker driver from at least one controlled group so as to generate at least one sound field associable with a dispersed profile.

BRIEF DESCRIPTION OF THE DRAWINGS

Embodiments of the disclosure are described hereinafter with reference to the following drawings, in which.

DETAILED DESCRIPTION

The present disclosure relates to a soundbar with elevation channel speakers which provide an extra dimension of height to user audible perception in addition to surround sound experience. The soundbar can, for example, be coupled (wirelessly and/or wired coupling) to a subwoofer so as to enhance audible perception of low frequency audio signals (i.e., bass).

Moreover, the soundbar can be configured to support a variety of Wi-Fi audio based protocol (e.g., "Airplay" developed by Apple Inc. and "Goggle Cast" developed by Google Inc.). Additionally, the soundbar can be configured to support music streaming services such as "Spotify" and "TuneIn". Furthermore, the soundbar can be configured so as to be usable as a Karaoke device. The soundbar can be configured to be capable of performing/supporting other audio related functions such as voice control.

In addition to audio related function(s) discussed above, the soundbar can be configured to be capable of supporting video related function(s). Specifically, the soundbar can be configured to support video playback from online sources such as "Netflix," "Hulu plus" and "HBO Go".

Therefore, the soundbar can be capable of one or both of audio related function(s) and video related function(s). Moreover, the soundbar can be capable of allowing/facilitating user storage of content.

As such, it is appreciable that the soundbar can be a user friendly device which serves as a sound, video and storage hub.

The soundbar will be discussed hereinafter with reference to FIG. 1 to FIG. 7. Additionally, the soundbar can simply can referred to as an apparatus.

Figure 1A:
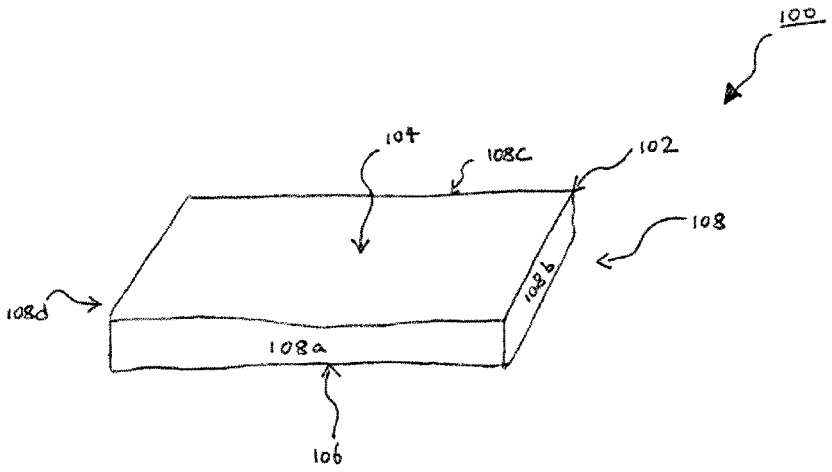
FIG. 1*a* shows a soundbar having a casing, according to an embodiment of the disclosure.

Referring to FIG. 1*a*, a soundbar 100 is shown is accordance with an embodiment of the disclosure. The sound bar 100 can include a casing 102 which includes a first face 104, a second face 106 and sides 108. The first and second faces 104/106 can be opposite each other and spaced apart such that the sides 108 are formed between the first and second faces 104/106. As such, the sides 108 can, for example, include a first side 108*a*, a second side 108*b*, a third side 108*c* and a fourth side 108*d*. The first side 108*a* and the third side 108*c* can be opposite sides whereas the second side 108*b* and the fourth side 108*d* can be opposite sides.

In an exemplary orientation of the soundbar 100, the first face 104 can be considered to be the top of the soundbar 100, the second face 106 can be considered to be the bottom of the soundbar 100, the first side 108*a* can be considered to be the front of the soundbar 100, the second side 108*b* can be considered to be the right side of the soundbar 100, the third side 108*c* can be considered to be the back of the soundbar 100, the fourth side 108*d* can be considered to be the left side of the soundbar 100.

Referring to FIG. 1*b*, FIG. 1*c*, FIG. 1*d* and FIG. 1*e*, the casing 102 can be shaped and dimensioned to carry a plurality of speaker drivers 110, a processing portion 112, a user control portion 114, an interface portion 115 and a connection portion 116. Additionally, the casing 102 can be shaped and dimensioned to carry one or more transmission portions 118 and/or one or more mounting portions 120.

Figure 1B:
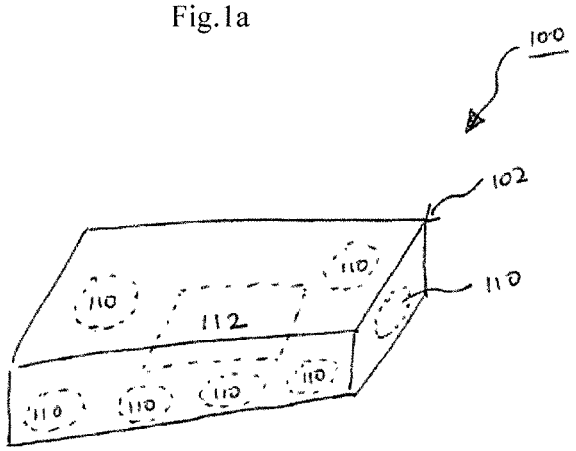
FIG. 1*b* shows that the casing of the soundbar of FIG. 1*a* can be shaped and dimensioned in a manner so as to carry a plurality of speaker drivers and a processing portion within the casing, according to an embodiment of the disclosure.

Specifically, FIG. 1*b* shows that the casing 102 can be shaped and dimensioned in a manner so as to carry the speaker drivers 110 and the processing portion 112 within (i.e., depicted by dotted lines) the casing 102, according to an embodiment of the disclosure. For example, although not explicitly shown in FIG. 1*b*, the casing 102 can be shaped and dimensioned in a manner so as to carry fifteen speaker drivers 110. The fifteen speaker drivers 110 can include a left channel speaker driver array having a "Mid-Tweeter-Mid" (MTM) configuration/a "Tweeter-Mid-Mid" (TMM) configuration (i.e., three speaker drivers 110), a right channel speaker driver array having a "Mid-tweeter-Mid" (MTM) configuration/a "Tweeter-Mid-Mid" (TMM) configuration (i.e., three speaker drivers 110), a center channel speaker driver array having a "Mid-Tweeter-Mid" (MTM) configuration (i.e., three speaker drivers 110), two additional channels having a "Mid-tweeter" (MT) speaker driver array configuration each (i.e., each channel having two speaker drivers 110) and yet further two channels having a full range speaker driver each (i.e., each channel having a speaker driver 110). In this regard, the fifteen speaker drivers can, for example, include eight mid-range speaker drivers (i.e., earlier mentioned "Mid"), five tweeters and two full range drivers. The processing portion 112 will be discussed later in further detail with reference to FIG. 3.

Additionally, it is preferable that the casing 102 can be shaped and dimensioned in a manner so that each of the speaker drivers 110 is housed within an individual chamber. For example, where there are fifteen speaker drivers 110, the casing 102 can include corresponding fifteen chambers and each speaker driver 110 can be carried by/housed within a corresponding chamber. Hence the speaker drivers 110, each being housed within an individual chamber, can be acoustically isolated from each other.

Moreover, it is preferable that the speaker drivers 110 can be individually controlled by the processing portion 112. This will be discussed later in further detail with reference to FIG. 5.

Figure 1C:
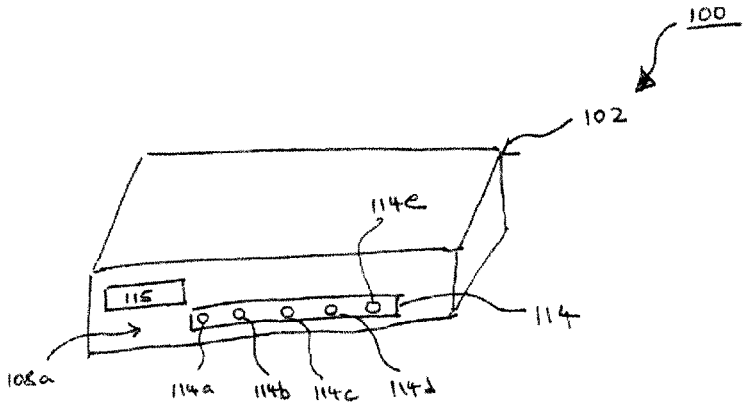
FIG. 1*c* shows that one of the sides of the casing of FIG. 1*a* can be shaped and dimensioned to carry a user control portion and an interface portion, according to an embodiment of the disclosure.

FIG. 1*c* shows that one of the sides 108 of the casing 102 can be shaped and dimensioned to carry the user control portion 114 and the interface portion 115, according to an embodiment of the disclosure. For example, the user control portion 114 and the interface portion 115 can be carried by the first side 108*a* of the casing. The user control portion 114 can be visually perceived and accessed by a user for the purpose of, for example, controlling the soundbar 100. As shown, the user control portion 114 can, for example, include a plurality of physical buttons such as a first push type button 114*a*, a second push type button 114*b*, a third push type button 114*c*, a fourth push type button 114*d* and a fifth push type button 114*e*. The interface portion 115 can include a receiver portion (not shown) for receiving command signals (e.g., infra-red signals from a remote control). The interface portion 115 will be discussed later in further detail with reference to FIG. 2.

Figure 1D:
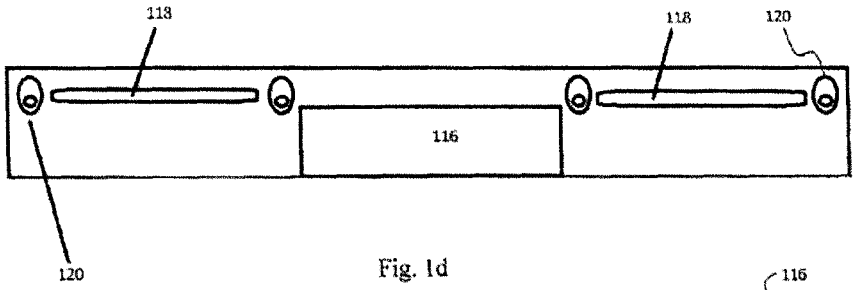
FIG. 1*d* shows that one of the sides of the casing of FIG. 1*a* can be shaped and dimensioned to carry a connection portion, one or more transmission portions and one or more mounting portions, according to an embodiment of the disclosure.

FIG. 1*d* shows that one of the sides 108 of the casing 102 can be shaped and dimensioned to carry the connection portion 116, one or more transmission portions 118 and one or more mounting portions 120, according to an embodiment of the disclosure. For example, the connection portion 116 can be carried by the third side 108*c* of the casing 102, and the casing 102 can be shaped and dimensioned so that the third side 108*c* can include a recessed bay within which the connection portion 116 can be carried. Moreover, the mounting portion(s) 120 can correspond to wall mount keyhole(s) facilitating the possibility of wall mounting the soundbar 100. Wall mounting of the soundbar 100 can, for example, be in accordance with VESA (i.e., Video Electronics Standards Association) Mounting Interface Standard (MIS). Appreciably, the recessed bay allows connected cables to remain out of sight (e.g., for aesthetic purposes) and, at the same time, facilitate the possibility of wall mounting of the soundbar 100.

The present application contemplates the possibility of the soundbar 100 physically blocking, for example, the Infra-Red (IR) receiver of an electronic device (e.g., a television) to which the soundbar 100 is paired. For example, the soundbar 100 could be used (i.e., paired) with a television and when the soundbar 100 and the television are placed together on a console, the television's IR receiver could be blocked by the soundbar 100. In this regard, the transmission portion 118 can be configured to retransmit any IR signals (e.g., communicated from the television's remote controller) received by the soundbar's 100 receiver portion at the interface portion 115 so that the device (e.g., television) paired with the soundbar 100 can still be remotely controlled (i.e., by the remote controller of the television).

The connection portion 116 can be visually perceived and accessed by a user for the purpose of, for example, connecting one or more peripheral devices to the soundbar 100. Appreciably, connection of peripheral device(s) to the soundbar 100 via the connection portion 116 can be via wired connection. An example of a peripheral device which can be connected to the soundbar 100 can be the aforementioned television. The connection portion 116 will be shown and discussed in further detail with reference to FIG. 1*e*.

Figure 1E:
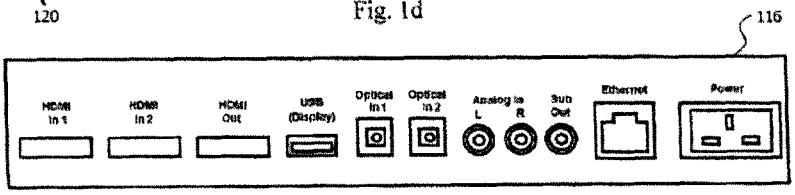
FIG. 1*e* shows the connection portion of FIG. 1*d* in further detail, according to an embodiment of the disclosure.

As shown in FIG. 1*e*, the connection portion 116 can include, for example, "Optical in" type connectors, "High Definition Multimedia Interface" (HDMI) type connectors, "Universal Serial Bus" (USB) type connector(s), an Ethernet connector, a 4 pole 3.5 mm Analog subwoofer out connector, RCA (Radio Corporation of America) type connectors and a IEC C14 power connector. The HDMI type connector(s) can, for example, include 2.0 A input type HDMI connector(s) supporting HDCP 2.2 for cabled devices and 2.0 A type HDMI type output connector(s) supporting audio return channel (ARC). The HDMI connector(s) can be used for connection to, for example, the aforementioned television. The USB type connector(s) can include a USB Host port for connection of an external display to the soundbar 100. The RCA connectors (i.e., "Analog In L R" in FIG. 1*e*) can be used for stereo analog inputs and the 4 pole 3.5 mm analog subwoofer out connector (i.e., "Sub Out" in FIG. 1*e*—for connection to a subwoofer device) can be used as a backup in Radio Frequency hostile environments. Earlier mentioned, one of the sides 108 of the casing 102 can be shaped and dimensioned to carry the interface portion 115. The interface portion 115 will be discussed in further detail with reference to FIG. 2 hereinafter.

Figure 2:
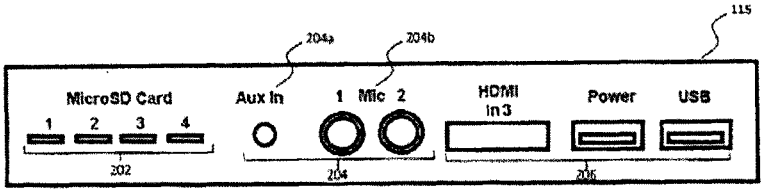
FIG. 2 shows the interface portion of FIG. 1*c* in further detail, according to an embodiment of the disclosure.

As shown in FIG. 2, the interface portion 115 can include a memory input portion 202, an analog input portion 204 and a digital input portion 206.

The memory input portion 202 can include one or more input slots for insertion of corresponding one or more memory devices such as memory cards/sticks. One example of a memory card is a secure digital card (i.e., SD card). Another example of a memory card is a micro SD card. As shown, the memory input portion 202 can, for example, include a first input slot (i.e., "MicroSD Card 1" in FIG. 2), a second input slot (i.e., "MicroSD Card 2" in FIG. 2), a third input slot (i.e., "MicroSD Card 3" in FIG. 2) and a fourth input slot (i.e., "MicroSD Card 4" in FIG. 2) for insertion of a first micro SD card, a second micro SD card, a third micro SD card and a fourth micro SD card respectively. The memory input portion 202 can facilitate user storage of content. Therefore, the soundbar 100 can be capable of allowing/facilitating user storage of content.

Preferably, the memory input portion 202 can be configured to have passcode control for either allowing or impeding access to content stored within the memory device(s). More preferably, passocde control can allow one or more of the memory devices "visible" and accessible provided that the correct passcode is provided.

The analog input portion 204 can include an auxiliary input portion 204*a* and a voice input portion 204*b*. The auxiliary input portion 204*a* can, for example, be in the form of a 3.5 mm female connector able to receive a jack. Similarly, the voice input portion 204*b* can, for example, include one or more connectors, each being in the form of a 3.5 mm female connector able to receive a jack.

The auxiliary input portion 204*a* can facilitate wired connection of the soundbar 100 to another audio device (not shown). The audio device (e.g., portable audio player) can communicate audio signals to the soundbar 100 which can act as a speaker for the audio device.

The voice input portion 204*b* can, for example, a first microphone input (i.e., "Mic 1" in FIG. 2) and a second microphone input (i.e., "Mic 2" in FIG. 2). Each of the microphone inputs can be used for receiving voice inputs from one or more users. In this regard, it is appreciable that the soundbar 100 can be used as a Karaoke device is desired. Further appreciably, if desired, the soundbar 100 can be capable of performing/supporting other audio related functions such as voice control.

The digital input portion 206 can include one or both of USB type connector(s) and HDMI type connector(s). As shown, the digital input portion 206 can, for example, include a HDMI type connector (i.e., "HDMI In 3" in FIG. 2), a power USB type connector (i.e., "Power" in FIG. 2) for supplying power to a peripheral device which may be plugged to the soundbar 100 via the "Power" USB type connector and a host USB type connector ("USB" in FIG. 2) for connection to, for example, a display device (e.g., a display screen) or additional an thumb drive/a hard disk.

Earlier mentioned, the casing 102 can be shaped and dimensioned in a manner so as to carry the processing portion 112. The processing portion 112 will be discussed in further detail hereinafter with reference to FIG. 3.

Figure 3:
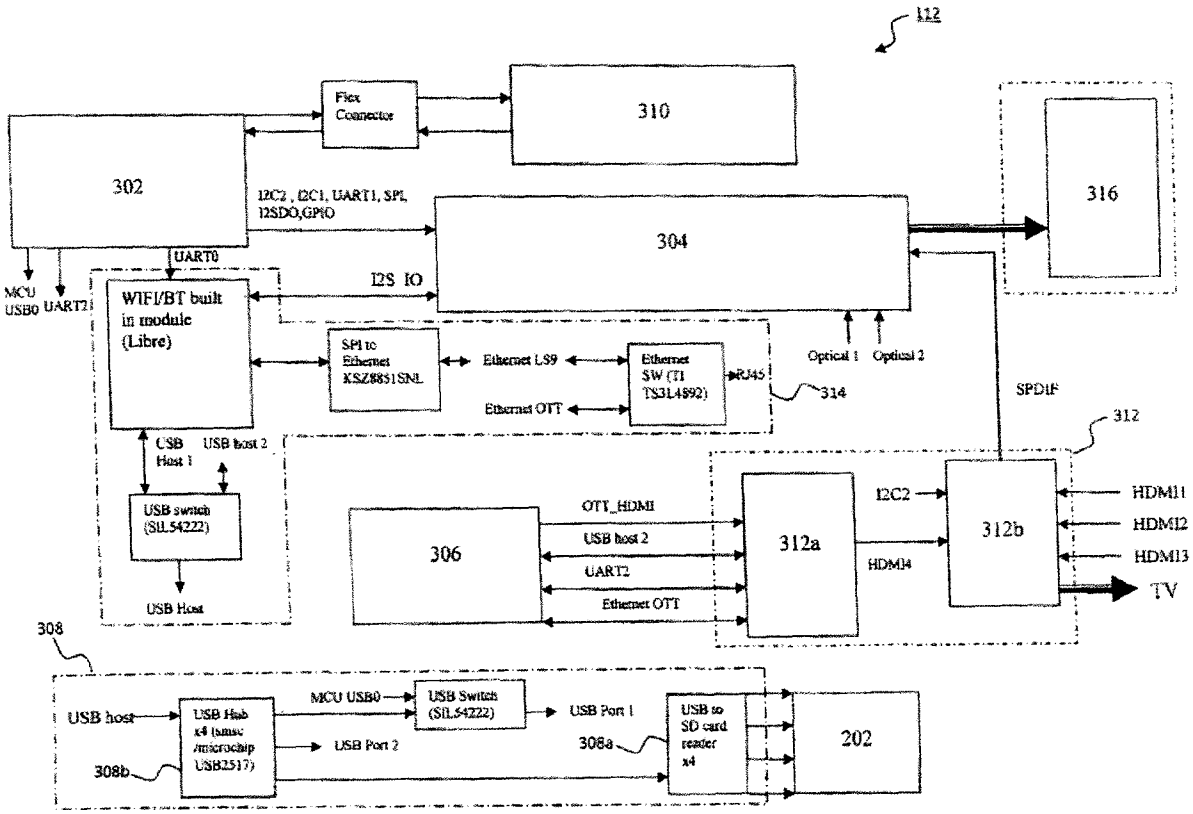
FIG. 3 shows the processing portion of FIG. 1*b* in further detail where the processing portion can include an audio module, according to an embodiment of the disclosure.

Referring to FIG. 3, the processing portion 112 can include a processor 302, an audio module 304, a video module 306, a memory module 308, a user interface module 310, an input/output (I/O) module 312, a transceiver module 314 and a speaker driver module 316.

The processor 302 can be coupled to each of the audio module 304, the video module 306, the memory module 308, the user interface module 310, the I/O module 312 and the transceiver module 314.

Specifically, the processor 302 can be coupled to the audio module 304 via a communication channel (i.e., "I2C2, I2C1, UART1, SOI, I2SDO, GPIO" as shown in FIG. 3). The processor 302 can be coupled to the video module 306 via another communication channel (i.e., "UART 2" as shown in FIG. 3). The processor 302 can be coupled to the memory module 308 via a connection (i.e., "MCU USB0" as shown in FIG. 3). The processor 302 can be coupled to the user interface module 310 via a connector (i.e., "Flex connector" as shown in FIG. 3). The processor 302 can be coupled to the I/O module 312 via a communication channel (i.e., "I2C2" as shown in FIG. 3). The processor 302 can be coupled to the transceiver module 314 via another communication channel (i.e., "UART 0" as shown in FIG. 3).

Furthermore, the audio module 304 can be coupled to the transceiver module 314 (i.e., "I2S IO" as shown in FIG. 3). The audio module 304 can be further coupled to the speaker driver module 316. The audio module 304 can yet be further coupled to the I/O module 312 via a communication channel (i.e., "SPDIF" as shown in FIG. 3). Moreover, one or both of at least a portion of the interface portion 115 and at least a portion of the connection portion 116 can be coupled to the audio module 304 as will be discussed later in further detail. The audio module 304 will be discussed later in further detail with reference to FIG. 4.

Additionally, the video module 306 can be coupled to the transceiver module 314 via one or more communication channels (i.e., "Ethernet OTT" and/or "USB host 2" as shown in FIG. 3). The video module 306 can be further coupled to the I/O module 312 via one or more communication channels (i.e., "OTT_HDMI, USB host 2, UART 2, Ethernet OTT" as shown in FIG. 3).

Moreover, the memory module 308 can be coupled to the transceiver module 314 via a connection (i.e., "USB Host" as shown in FIG. 3). The memory module 308 can be further coupled (not shown) to one or both of the audio module 304 and the video module 306.

Operationally, the processor 302 can, for example, be a microprocessor. The user interface module 310 can be coupled to the user control portion 114. For example, as a user interacts with any of the first to fifth push type buttons 114*a*/114*b*/114*c*/114*d*/114*e*, the user interface module 310 can be configured to detect which of the first to fifth push type button/buttons 114*a*/114*b*/114*c*/114*d*/114*e* has/have been pressed, and generate input signals accordingly. The input signals can be communicated to the processor 302 which can, in turn, generate control signals based on the input signals. The control signals can be communicated from the processor 302 to any of the audio module 304, the video module 306, the memory module 308, the user interface module 310, the I/O module 312 and the transceiver module 314, or any combination thereof. Specifically, control signals can be communicated from the processor 302 to the audio module 304, the video module 306, the memory module 308, the user interface module 310, the I/O module 312 and/or the transceiver module 314 via the appropriate connection(s) and/or communication channel/channels mentioned earlier.

Earlier mentioned, the soundbar 100 can be configured to support music streaming services and support video playback from online sources.

Such functions can be made possible by the transceiver module 314 which can be coupled to one or more online sources via a network (not shown).

In one example, in the case of audio streaming, the transceiver module 314 can be configured to communicate with an online music source (e.g., "Spotify") and data from the online music source can be further communicated to the audio module 304 for further processing to produce audio output signals. The audio output signals can be communicated to the speaker driver module 316 which can correspond to, for example, an analog speaker amplifier. The speaker driver module 316 can be coupled to the aforementioned plurality of speaker drivers 110. In this regard, the speaker driver module 316 can be configured to amplify the audio output signals so that they can be audibly perceived by a user of the soundbar 100.

In another example, in the case of video streaming, the transceiver module 314 can be configured to communicate with an online video source (e.g., "Netflix") and data from the online video source can be further communicated to the video module 306 for further processing to produce video output signals. The video module 306 can, for example, correspond to an "Over The Top" (OTT) Android based television module which can be coupled to a television set external to the soundbar 100. Specifically, the soundbar 100 can be coupled to a television set (not shown) to display the video output signals. The television set can be coupled to the video module 306 via the I/O module 312 (i.e., "TV" as shown in FIG. 3).

The I/O module 312 can be coupled to the connection portion 116. In this regard, the I/O module 312 can, for example, be HDMI based, and can include an interface port 312*a* and a HDMI processor 312*b*. It is appreciable that a peripheral device (not shown) can be coupled to the soundbar 100 and that data signals from the peripheral device can be communicated to the soundbar 100 via a HDMI connection (e.g., "HDMI 1"). For example, the peripheral device can be an audio signal generating device and audio signals generated can be communicated to the audio module 304 via a connection (i.e., "SPDIF" as shown in FIG. 3) between the I/O module 312 and the audio module 304. The audio module 304 can process the audio signals (from the peripheral device) to produce audio output signals which can be communicated to the speaker driver module 316. Similarly, output signals (e.g., video output signals) can be communicated from the soundbar 100 to a peripheral device connected to it. For example, a television set can be coupled to the soundbar 100 via the connection portion 116 (e.g., "HDMI out" as shown in FIG. 1*e*) and video output signals can be communicated via a signal line of the I/O module 312 (e.g., "TV" as shown in FIG. 3) coupled to, for example, "HDMI out" of the connection portion 116.

The memory module 308 can be coupled to the memory input portion 202 which can, for example, be in the form of a SD card slot module having a plurality of card slots. The memory module 308 can include a reader 308*a* (e.g., capable of reading the inserted SD card(s)). In one example, the memory input portion 202 can include four SD card slots. Therefore, the memory input portion 202 can carry four SD cards and the reader 308*a* can read up to four SD cards. The memory module 308 can also be coupled to the digital input portion 206 (e.g., USB type connector(s)). In this regard, the memory module 308 can further include a hub 308*b* such as a USB based hub.

Therefore, it is appreciable that one or more memory devices (e.g., USB sticks and/or SD cards) can be inserted to the soundbar 100 and content (e.g., audio based content and/or video based content) stored within the inserted memory device(s) can be read and communicated to one or both of the audio module 304 and the video module 306 for, for example, the purpose of playback.

The audio module 304 will be discussed in further detail with reference to FIG. 4 hereinafter.

In accordance with an embodiment of the disclosure, the audio module 304 can include a primary audio processor 402, an intermediate audio processor 404 and a secondary audio processor 406. In accordance with another embodiment of the disclosure, audio module 304 can further include a wireless communication module 408, an analog to digital converter (ADC) 410 and one or more digital to analog converters (DAC) 412. In accordance with yet another embodiment of the disclosure, the audio module 304 can yet further include one or both of a wireless audio module 414 and a multiplexer 416.

As shown, the primary audio processor 402 can be coupled to the intermediate audio processor 404. The intermediate audio processor 404 can be coupled to the secondary audio processor 406. The wireless communication module 408 and the ADC 410 can be coupled to the primary audio processor 402. The DAC(s) 412 can be coupled to the secondary audio processor 406. The wireless audio module 414 can be coupled to the primary audio processor 402 and the secondary audio processor 406. The multiplexer 416 can be coupled to the intermediate audio processor 404.

Additionally, the processor 302 can be coupled to the primary audio processor 402 and the DAC(s) 412 can be coupled to the speaker driver module 316. Furthermore, the processor 302 can be coupled to the wireless communication module 408.

Earlier mentioned, one or both of at least a portion of the interface portion 115 and at least a portion of the connection portion 116 can be coupled to the audio module 304.

In the case of the interface portion 115, the analog input portion 204 can be coupled to the audio module 304 in accordance with an embodiment of the disclosure. Specifically, the auxiliary input portion 204*a* and the voice input portion 204*b* can be coupled to the audio module 304. For example, the auxiliary input portion 204*a* can be coupled to the ADC 410 ("AUX IN" as shown in FIG. 4). The voice input portion 204*b* can be coupled to the intermediate audio processor 404 and/or the multiplexer 416 ("Mic AM," "Mic C, D" and "External MIC 1,2" as shown in FIG. 4). As an option, the multiplexer 416 can be configured to select voice input signals received from the voice input portion 204*b* (e.g., select between "Mic C, D" and External MIC 1, 2" as shown in FIG. 4) and the selected voice input signals can be further communicated to the intermediate audio processor 404 for processing.

Figure 4:
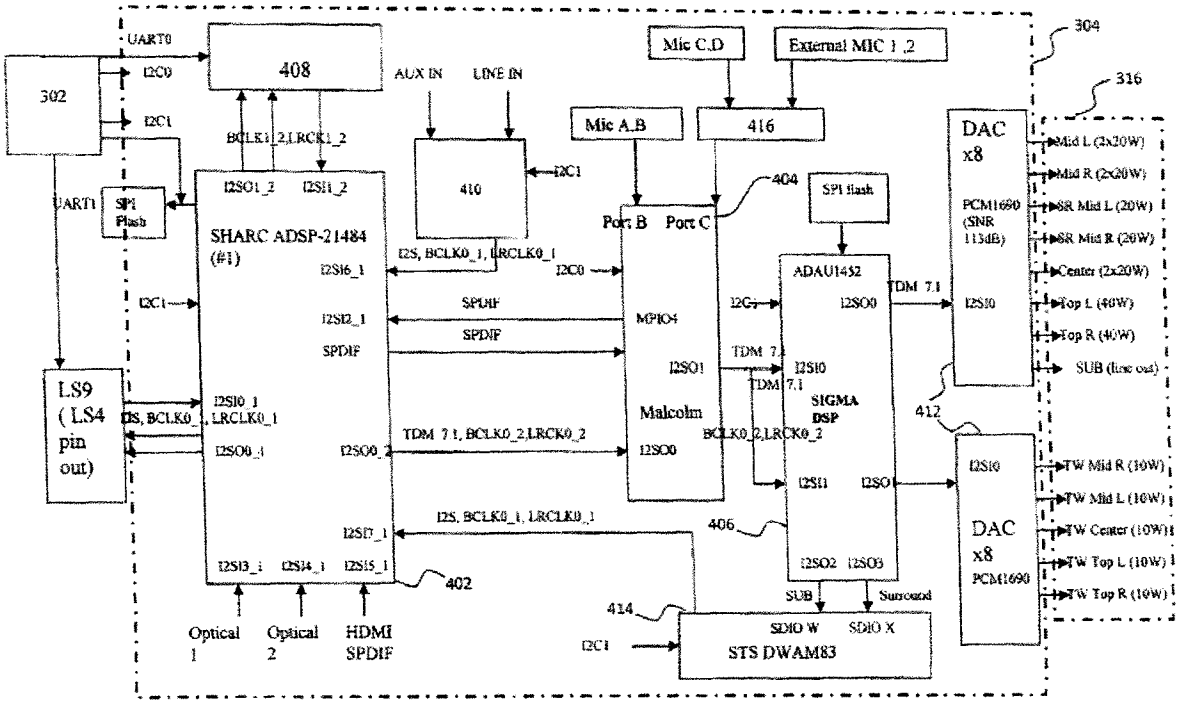
FIG. 4 shows the audio module of FIG. 3 in further detail where the audio module can include a primary audio processor, an intermediate audio processor and a secondary audio processor, according to an embodiment of the disclosure.

In the case of the connection portion 116, the "Optical in" type connector(s) and the HDMI type connector(s) can be coupled to the audio module 304 in accordance with an embodiment of the disclosure (e.g., connection of "Optical 1," "Optical 2," and HDMI" to the primary audio processor 402 as shown in FIG. 4).

The primary audio processor 402 can, for example be Analog Device's "SHARC®" Processor for Dolby® Atmos®. The intermediate audio processor 404 can, for example, be "Malcolm chip+Recon3Di AP" from Creative Technology Ltd. The secondary audio processor 406 can, for example, be Analog Device's "SigmaDSP®" processor.

The wireless communication module 408 can, for example, be a Bluetooth based communication module for wireless streaming of, for example, audio signals from a peripheral device (e.g., Media player device) wirelessly paired with the soundbar 100.

The wireless audio module 414 can, for example, be configured to communicate with a subwoofer device (not shown) paired with the soundbar 100. Audio based output signals (e.g., "SUB" and "Surround" as shown in FIG. 4) can be communicated from the secondary audio processor 406 to the wireless audio module 414 which can further communicate the audio based output signals to a paired subwoofer device. As mentioned earlier, in Radio Frequency hostile environments and wired coupling is preferred, the 4 pole 3.5 mm analog subwoofer out connector (i.e., "Sub Out" in FIG. 1*e*—for connection to a subwoofer device) can be used. Moreover, control signals can be communicated ("I2C1" as shown in FIG. 4) from the processor 302 to control the wireless audio module 414.

Earlier mentioned, it is preferable that the speaker drivers 110 can be individually controlled by the processing portion 112. Specifically, the speaker drivers 110 can be individually controlled by the secondary audio processor 406 in accordance with an embodiment of the disclosure. It is appreciable that housing each of the speaker drivers 110 within an individual chamber (i.e., one speaker driver only per chamber) facilitates the possibility of individual control of the speaker drivers 110 by the secondary audio processor 406. The secondary audio processor 406 can be referred to as a control processor 502 in the context of FIG. 5.

Figure 5:
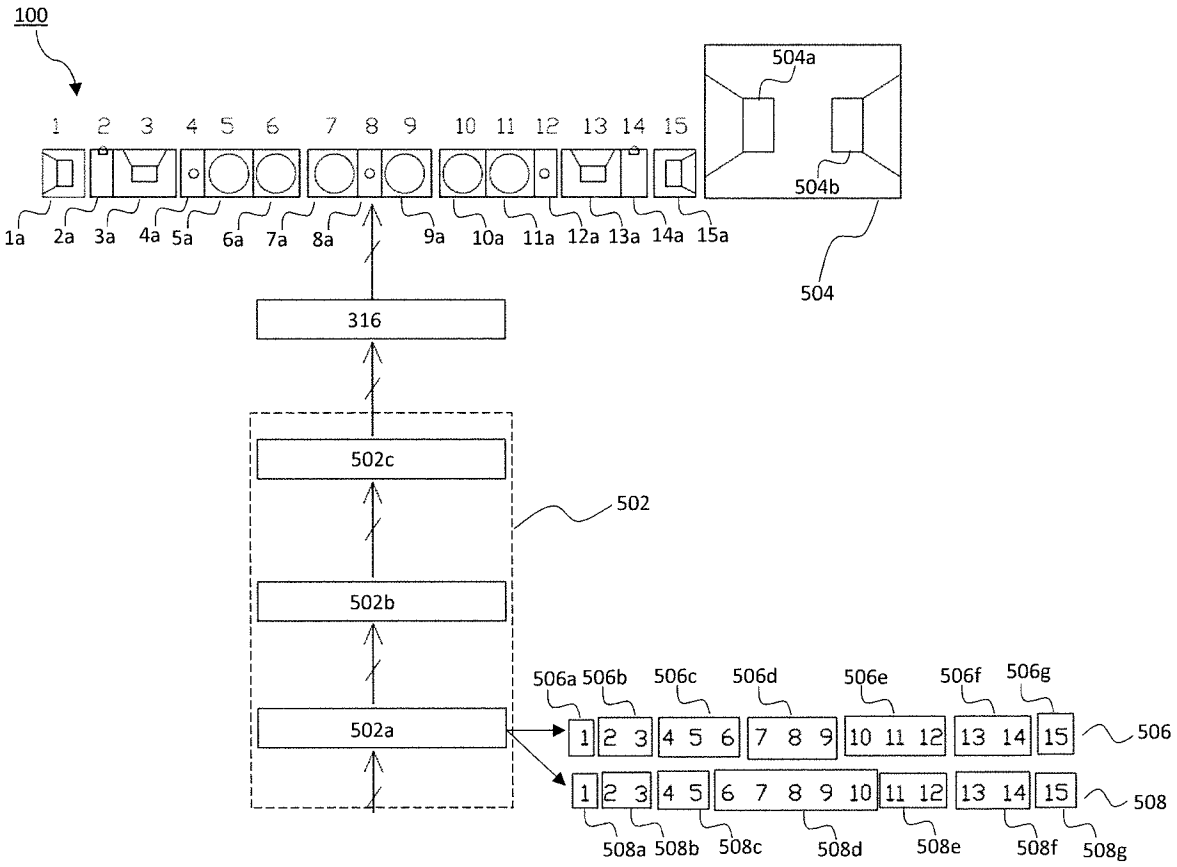
FIG. 5 shows that the secondary audio processor of FIG. 4, which can be referred to as a control processor, can be configured to perform one or more tasks so as to, in one exemplary application, generate one or more sound fields, according to an embodiment of the disclosure.

As shown in FIG. 5, the control processor 502 can be configured to perform one or more tasks which can include:

i) speaker grouping 502*a* ii) speaker crossover 502*b* iii) speaker delay and directivity 502*c*

It is understood that not all of the tasks (i.e., I to iii) need to be carried out/performed. Specifically, the control processor 502 can be configured to perform any one or more of the tasks (i) to (iii), or any combination thereof. Moreover, the tasks need not necessarily be carried out/performed in the sequence outlined above.

From earlier discussion (i.e., FIG. 4), the control processor 502, which corresponds to the aforementioned secondary audio processor 406, can be coupled to the speaker driver module 316 (e.g., an amplifier). The speaker driver module 316 can be coupled to the speaker drivers 110.

Based on an earlier example, the speaker driver module 316 can be coupled to fifteen speaker drivers 110 (as represented by numerals "1" to "15" in FIG. 5).

The aforementioned left channel speaker driver array (e.g., in a TMM configuration) can be represented by numerals "4," "5" and "6". The aforementioned right channel speaker driver array (e.g., in a MMT configuration) can be represented by numerals "10," "11" and "12". The aforementioned center channel speaker driver array (e.g., in a MTM configuration) can be represented by numerals "7," "8" and "9". The aforementioned two additional channels (e.g., each having a MT speaker driver array configuration) can be represented by numerals "2," "3" (i.e., for the first additional channel) and numerals "13," "14" (i.e., for the second additional channel). The aforementioned yet further two channels (e.g., each having a full range speaker driver) can be represented by numeral "1" (i.e., for the first further channel) and numeral "15" (i.e., for the second further channel).

In this regard, in FIG. 5, it is appreciable that the "tweeter" speaker drivers can be represented by numerals "2," "4," "8," "12" and "14". The "Mid" speaker drivers can be represented by numerals "3," "5," "6," "7," "9," "10," "11," and "13". The full range speaker drivers can be represented by numerals "1" and "15". It is further appreciable that each of the speaker drivers 110 is housed by an individual chamber. For example, speaker driver numeral "1" to speaker driver numeral "15" are housed by individual chamber 1*a* to individual chamber 15*a* respectively.

Moreover, it was mentioned earlier that the soundbar 100 can be paired with a subwoofer device. An example, as shown in FIG. 5, is a subwoofer device 504 which includes two speaker drivers 504*a*, 504*b*.

In regard to speaker grouping 502*a*, the control processor 502 can be configured to flexibly group the speaker drivers 110, in accordance with an embodiment of the disclosure. For example, the control processor 502 can be programmed (firmware etc.) to generate control signals so as to assign one or more speaker drivers 110 to a group.

In one example 506, the speaker drivers 110 can be grouped by the control processor 502 into seven groups (i.e., a first group 506*a* to a seventh group 506*g*). The first group 506*a* can include speaker driver numeral 1. The second group 506*b* can include speaker driver numerals 2 and 3. The third group 506*c* can include speaker driver numerals 4, 5 and 6. The fourth group 506*d* can include speaker driver numerals 7, 8 and 9. The fifth group 506*e* can include speaker driver numerals 10, 11 and 12. The sixth group 506*f* can include speaker driver numerals 13 and 14. The seventh group 506*g* can include speaker driver numeral 15.

In another example 508, the speaker drivers 110 can be grouped by the control processor 502 into seven groups (i.e., a first group 508*a* to a seventh group 508*g*). The first group 508*a* can include speaker driver numeral 1. The second group 508*b* can include speaker driver numerals 2 and 3. The third group 508*c* can include speaker driver numerals 4 and 5. The fourth group 508*d* can include speaker driver numerals 6, 7, 8, 9 and 10. The fifth group 508*e* can include speaker driver numerals 11 and 12. The sixth group 508*f* can include speaker driver numerals 13 and 14. The seventh group 508*g* can include speaker numeral 15.

Flexibly grouping of the speaker drivers 110 by the control processor 502 can have useful applications.

One exemplary application can be to boost audio output from a preferred (i.e., per user preference) segment of the soundbar 100. For example, it may be desired that the center channel segment of the soundbar 100 has a more weighted audio output as compared to the left and right channel segments. This can be achieved by configuring the control processor 502 to assign more speaker drivers to the center channel segment. Specifically, based on example 506 and example 508, it is appreciable that the fourth group 506*d*, 508*d* can be considered to be the center channel segment (whereas the third group 506*c*, 508*c* and the fifth group 506*e*, 508*e* can be considered to be the left channel segment and the right channel segment respectively). More specifically, comparing example 506 and example 508, it is appreciable that more speaker drivers (i.e., numeral 6 and numeral 10) have been assigned to the center channel segment in example 508. Therefore, the grouping arrangement based on example 508 would provide a more weighted audio output (i.e., boost in audio output) from the center channel segment as compared to the grouping arrangement based on example 506.

Another exemplary application can be to flexibly adjust one or more sound fields which can be responsible for providing a user (i.e., of the soundbar 100) with a "super-wide stereo" audible perception. Appreciably, given an exemplary soundbar 100 configuration of fifteen speaker drivers 110 paired with a two speaker driver subwoofer device 504, a "15.2 super-wide stereo" listening experience can be provided to a user. The sound field(s) will be discussed later in further detail with reference to FIG. 6.

In regard to speaker crossover 502*b*, it is appreciable that some of the speaker drivers 110 are more suitable for audio output of a certain range of audio frequencies whereas some of the speaker drivers 110 are more suitable for audio output of another certain range of audio frequencies. For example, a portion of the speaker drivers 110 can be high frequency based speaker drivers (i.e., "tweeter" speaker drivers) suitable for audio output of high frequency audio signals (e.g., above 4 KHz) and a portion of the speaker drivers 110 can be mid-frequency based speaker drivers (i.e., "Mid" speaker drivers) suitable for audio output of mid-range frequency audio signals (e.g., 100 Hz to 4 KHz). Therefore, the control processor 502 can, in accordance with an embodiment of the disclosure, be configured to perform the task of speaker crossover 502*b* so that appropriate audio signals can be output by appropriate speaker drivers 110 (e.g., audio signals above 4 KHz are to be output by "tweeter" speaker drivers such as numerals 4, 8 and 12, whereas audio signals from 100 Hz to 4 KHz to be output by "Mid" speaker drivers such as numerals 5, 6, 9, 10 and 11).

In regard to speaker delay and directivity 502*c*, the control processor 502 can, in accordance with an embodiment of the disclosure, be configured to perform the task of controlling direction of audio output of one or more speaker drivers 110 and providing a time delay in regard to the audio output of one or more speaker drivers 110. By performing the task of speaker delay and directivity 502*c*, one or more sound fields can be generated so as to facilitate "super-wide stereo" (e.g., "15.2 super-wide stereo") audible perception. Moreover, as mentioned earlier, the option of flexibly grouping the speaker drivers 110 (i.e., in regard to speaker grouping 502*a*) can provide the possibility of flexibly adjusting the sound field(s).

The sound field(s) will be discussed in the context of an exemplary setup with reference to FIG. 6 hereinafter.

Figure 6:
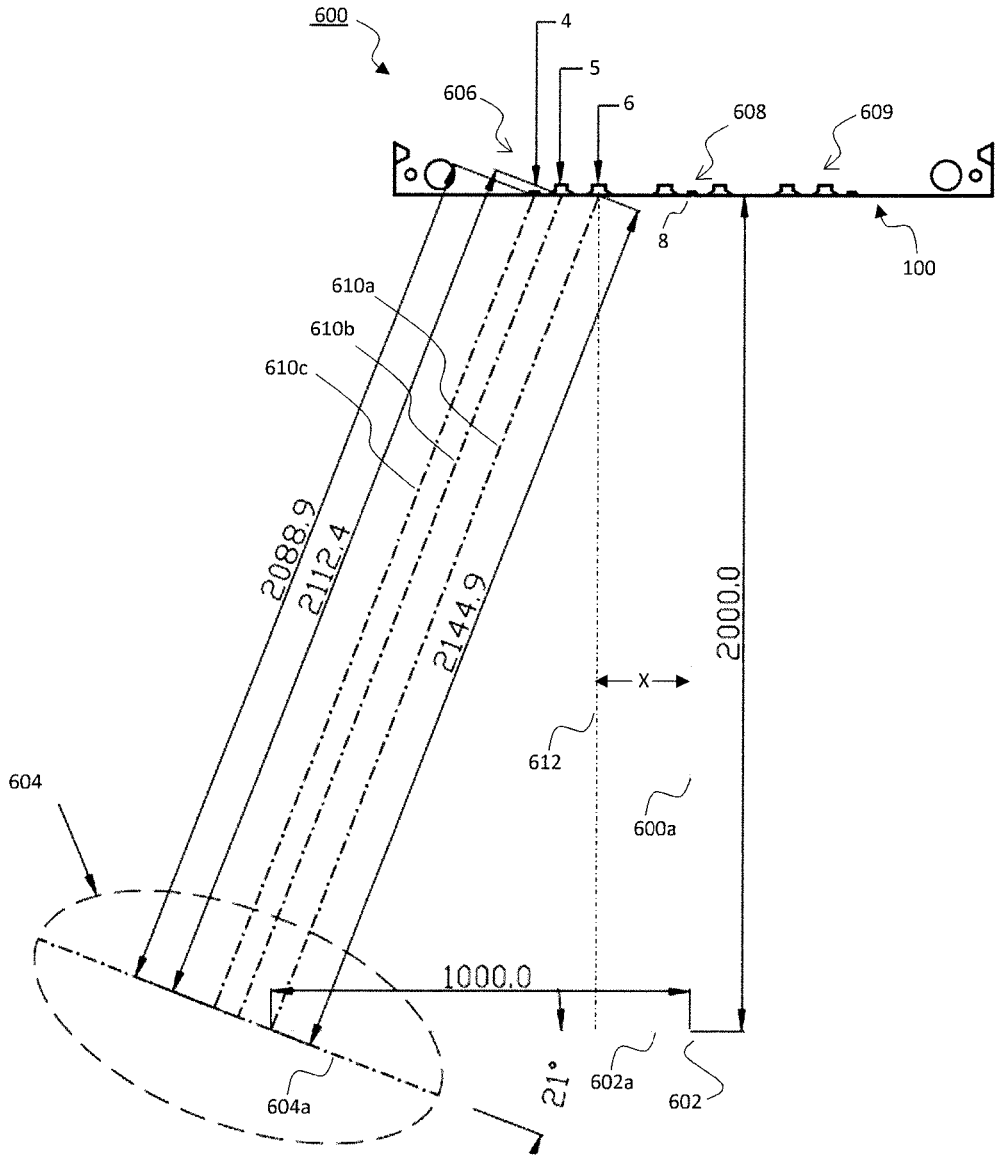
FIG. 6 shows an exemplary setup, in association with the soundbar of FIG. 1*a*, for generating one or more sound fields, according to an embodiment of the disclosure.

Referring to FIG. 6, an exemplary setup 600 is shown in accordance with an embodiment of the disclosure. A user 602 can be positioned 2000 millimeters (mm) away from the soundbar 100 and it is desired that a sound field 604, having a reference axis 604*a*, is generated at about 1000 mm to the left hand side of the user 602. Additionally, it is desired that the sound field 604 is offset at an angle of 21 degrees from a horizontal axis 602*a* extending from the user 602 towards the sound field 604. Moreover, the speaker driver numerals "4," "5" and "6" can be grouped (i.e., assigned by the control processor 502) as a left channel segment 606 of the soundbar 100. Additionally, the speaker driver numerals "7," "8" and "9" can be grouped (i.e., assigned by the control processor 502) as a center channel segment 608 of the soundbar 100. Moreover, the speaker driver numerals "10," "11 and "12" can be grouped (i.e., assigned by the control processor 502) as a right channel segment 609 of the soundbar 100.

Specifically, as signified by line 600*a* (which is perpendicular to the soundbar 100 and cuts through the center channel segment 608) a user 602 can be facing the soundbar 100 and positioned approximately 2000 mm away from the soundbar 100. Further, as signified by horizontal axis 602*a*, a sound field 604 can be generated, based on the left channel segment 606, approximately 1000 mm (i.e., with reference to, for example, speaker driver numeral "6" which is closest, as compared to speaker driver numerals "4" and "5", to the center channel segment 608) to the left of the user 602. In this regard, the speaker driver numeral "6" can also be referred to as a reference speaker driver to the remaining speaker drivers (e.g., numerals "4" and "5") in the left channel segment 606 for the purpose of, for example, determining delay. Additionally, as signified by "X" (i.e., distance between lines 600*a* and 612), the reference speaker driver (i.e., speaker driver numeral "6" can be positioned 225 mm apart from the speaker driver numeral "8". Moreover, as mentioned earlier, it is desired that the sound field 604 is offset at an angle of 21 degrees (i.e., intersection angle based on the reference axis 604*a* and the horizontal axis 602*a*).

Directivity of audio output from speaker driver numerals "6," "5" and "4" can be represented by dotted lines 610*a*, 610*b* and 610*c* respectively. As shown. directivity of audio output from the speaker drivers 110 can, for example, be collimated based directivity output (i.e., the dotted lines 610*a*, 610*b* and 610*c* are substantially parallel with respect to each other). Dotted line 610*a* represents the distance between speaker driver numeral "6" and the reference axis 604*a*. Dotted line 610*b* represents the distance between speaker driver numeral "5" and the reference axis 604*a*. Dotted line 610*c* represents the distance between the speaker driver numeral "4" and the reference axis 604*a*.

The length of dotted line 610*a* can be determined to be 2144.9 mm based on Pythagoras theorem using the following lines:

A) line 612 (which is of equivalent length to line 600*a* which is 2000 mm); and B) line 600*b* (which is 1000 mm) discounting "X" (which is 225 mm).

Specifically, length of dotted line 610*a* (i.e., 2144.9)= square root of: $2000^2+(1000-225)^2$.

In this regard, it is appreciable that the length of dotted line 610*a* can be determined based on the following parameters:

1) Distance between a user and the soundbar 100 (i.e., signified by line 600*a*)

2) Distance between the user and sound field 604 (i.e., signified by line 602*a*)

3) Distance between the reference speaker driver (speaker driver numeral "6") and the speaker driver (speaker driver numeral "8") through which line 600*a* cuts through.

Appreciably, the length of dotted lines 610*b* and 610*c* can be determined in an analogous manner. Since dotted lines 610*b* and 610*c* are based on speaker driver numeral "5" and speaker driver numeral "4" respectively, it is further appreciable that there is need to take into account their respective distances relative to speaker driver numeral "8".

Based on this exemplary setup 600, the length of the dotted lines 610*b* and 610*c* can be determined to be 2112.4 mm and 2088.9 mm respectively.

Hence, to generate the sound field 604, the control processor 502 can be configured to perform:

1) the task of controlling direction of audio output of the speaker driver numerals "4," "5" and "6"; and 2) providing a time delay, with reference to the reference speaker driver (i.e., speaker driver numeral "6"), in regard to the audio output of each of the speaker driver numeral "4" and the speaker driver numeral "5".

Specifically, time delay should be provided for audio output of each of the speaker driver numeral "4" and the speaker driver numeral "5" so as to attain the aforementioned reference axis 604*a* which is offset at an angle of 21 degrees from a horizontal axis 602*a* extending from the user 602 towards the sound field 604.

The time delay to be applied in respect of the speaker driver numeral "4" is: (length of dotted line 610*a* minus length of dotted line 610*c*)/speed of sound. For example, ((2144.9−2088.9)/1000)/344=0.163 milliseconds (or approximately 8 samples at 48 KHz sampling rate which is equivalent to 8/48000).

The time delay to be applied in respect of the speaker driver numeral "5" is: (length of dotted line 610*a* minus length of dotted line 610*b*)/speed of sound. For example, ((2144.9−2112.4)/1000)/344=0.095 milliseconds (or approximately 5 samples at 48 KHz sampling rate which is equivalent to 5/48000).

Appreciably, the profile (i.e., as represented by dotted oval 604) of the sound field 604 is based on a non-converging type directivity output (i.e., where the outputs do not converge to one point). Preferably, the profile of the sound field 604 is based on collimated based directivity output where time delay is applied to the audio output of each of speaker driver numeral "4" (e.g., 0.163 milliseconds) and speaker driver numeral "5" (e.g., 0.095 milliseconds) so that, together with audio output from the speaker driver numeral "6", the reference axis 604*a* can be formed (i.e., imaginary line drawn across, and connecting, the ends of dotted lines 610*a*, 610*b* and 610*c*).

Alternatively, a diverging based directivity output (i.e., where the outputs diverge and are non-collimated) is also possible. Appreciably, time delay and directivity for the speaker driver(s) of the left channel segment 606 would need to be adjusted accordingly so as to form the reference axis 604*a*, per earlier discussion concerning collimated based directivity output, in order to generate the sound field 604.

By generating a sound field based on a non-converging type directivity output (i.e., as opposed to converging to one point), the "sweet spot" for audible perception can be considerable enlarged. This is in contrast/comparison to converging type directivity output where there would be significantly higher requirement for precise user positioning for audible perception (i.e., limited "sweet spot" area). In this regard, the sound field 604 can be considered to be associable with a dispersed profile.

Additionally, although exemplary setup 600 has been discussed in much detail in the context of generating a sound field 604 by manner of appropriate adjustment(s) and/or control (i.e., controlling directivity and/or providing time delay(s)) of the left channel segment 606 by the control processor 502, it can be appreciated that one or more other sound fields can be generated. For example, as with the left channel segment 606, the control processor 502 can, analogously, be further configured to control direction of audio output and provide appropriate time delay(s) in relation to one or more speaker drivers of the right channel segment 609 so as to generate another sound field to the right side of the user 602.

Hence it is appreciable that, in general, the soundbar 100 (i.e., which can be simply referred to as an apparatus) can include a plurality of speaker drivers 110 and a control processor 502.

The control processor 502 can be configured to:

1) flexibly group the speaker drivers 110 (i.e., into one or more groups such as the aforementioned left channel segment 606, center channel segment 608 and right channel segment 609)
2) perform the tasks of controlling directivity of audio output from at least one group (e.g., the left channel segment 606, the center channel segment 608 and/or the right channel segment 609) and providing time delay to audio output from at least one speaker driver (e.g., per exemplary setup 600, a time delay of 0.163 milliseconds is provided in connection with speaker driver numeral "4" and a time delay of 0.095 milliseconds is provided in connection with speaker driver numeral "5") from at least one controlled group (e.g., per exemplary setup 600, the left channel segment 606 can be considered to be the controlled group since the control processor 502 is controlling/adjusting directivity of audio output from speaker driver numerals "6," "5" and "4") so as to generate at least one sound field 604 associable with a dispersed profile (i.e., the sound field 604 is considered to be based on a non-converging type directivity output).

In the foregoing manner, various embodiments of the disclosure are described for addressing at least one of the foregoing disadvantages. Such embodiments are intended to be encompassed by the following claims, and are not to be limited to specific forms or arrangements of parts so described and it will be apparent to one skilled in the art in view of this disclosure that numerous changes and/or modification can be made, which are also intended to be encompassed by the following claims.

Figure 7:
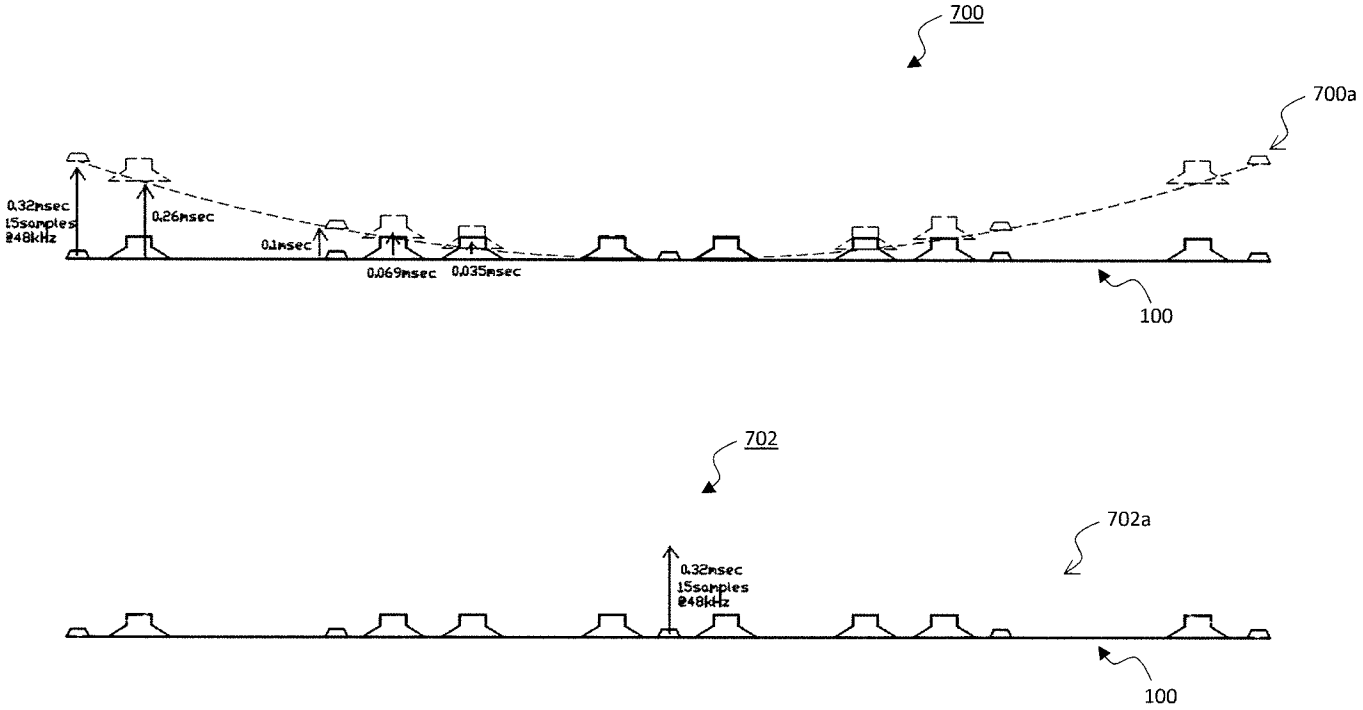
FIG. 7 illustrates a convex speaker arrangement and a concave speaker arrangement in association with the exemplary setup of FIG. 6, according to an embodiment of the disclosure.

For example, as shown in FIG. 7, based on exemplary setup 600, the control processor 502 controlling and/or adjusting the left and right channel segments 606, 609 would effectively result in a convex speaker arrangement/formation 700 (i.e., imaginary convex dotted depiction 700*a*), in accordance with an embodiment of the disclosure. It is appreciable that by appropriate adjustment and/or control of speaker drivers in the left, center and right channel segments 606, 608, 609, a concave speaker arrangement/formation 702 (i.e., imaginary concave dotted depiction 702*a*) can also be possible, in accordance with another embodiment of the disclosure.

The imaginary convex dotted depiction 700*a* and the imaginary concave dotted depiction 702*a* signify the effective audio output audibly perceivable by a user (i.e., although it may sound to a user like the speaker drivers 110 have been arranged in a convex/concave arrangement, but the speaker drivers 110 themselves need not necessarily be physically arranged/positioned as such).

The invention claimed is:

1. An apparatus having a plurality of speaker drivers, the apparatus comprising:

a control processor configured to:

flexibly group the speaker drivers into a plurality of groups; and control directivity of audio output from at least one group from the plurality of groups and provide time delay to audio output from less than all the speaker drivers in the at least one controlled group so as to generate at least one sound field associable with a dispersed profile, wherein the dispersed profile based on the time delay provides a sweet spot for audible perception that is not based on converging directivity output, wherein the at least one controlled group is not a center channel segment, and wherein directivity of audio output is controlled such that audio output from each of the at least one controlled group is based on a substantially common direction directivity output.

2. The apparatus as in claim 1, wherein directivity of audio output is controlled such that audio output from the at least one controlled group is based on non-converging directivity output.

3. The apparatus as in claim 2, wherein directivity of audio output is controlled such that audio output from the at least one controlled group is based on collimated directivity output.

4. The apparatus as in claim 2, wherein directivity of audio output is controlled such that audio output from the at least one controlled group is based on diverging directivity output.

5. The apparatus as in claim 1, wherein the at least one controlled group is either a left channel segment or a right channel segment, and wherein the left channel or right channel segment comprises a subset of the plurality of speaker drivers with one of the speaker drivers being a reference speaker driver to the remaining speaker drivers in the subset of the plurality of speaker drivers.

6. The apparatus as in claim 5, wherein time delay is provided to audio output from the remaining speaker drivers, and wherein time delay provided is based on position of the reference speaker driver with respect to the remaining speaker drivers.

7. The apparatus as in claim 6, wherein time delay provided to audio output from the remaining speaker drivers is based on distance between the reference speaker driver and each respective remaining speaker driver.

8. The apparatus as in claim 1, wherein the at least one controlled group is positioned along a horizontal axis, wherein the at least one sound field has a reference axis that is perpendicular to the directivity of audio output from one of the speakers in the at least one controlled group, and wherein the reference axis and the horizontal axis intersect at an angle to facilitate generation of the at least one sound field associable with the dispersed profile.

9. The apparatus as in claim 8, wherein the angle is about 21 degrees.

10. The apparatus as in claim 1, wherein when a user is positioned directly across the middle of the center channel segment, the user is also positioned on a horizontal axis that is parallel to the center channel segment, wherein the at least one sound field has a reference axis that is perpendicular to the directivity of audio output from one of the speakers in the at least one controlled group, and wherein the reference axis and the horizontal axis intersect at an angle to facilitate generation of the at least one sound field associable with the dispersed profile.

11. The apparatus as in claim 10, wherein the angle is about 21 degrees.

* * * * *